US006145998A

United States Patent [19]

Lynch et al.

[11] Patent Number: 6,145,998

[45] **Date of Patent: *Nov. 14, 2000**

[54] DEMONSTRATION DISPLAY FOR LIGHTING CONTROLS

[75] Inventors: Carol Lynch, Farmingdale; Kurt L. Haverkost, Bedford Corners, both of N.Y.

[73] Assignee: Leviton Manufacturing Co., Inc., Little Neck, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/107,936

[22] Filed: Jun. 30, 1998

[51] Int. Cl.[7] ..... F21V 23/04

[52] U.S. Cl. ..... 362/251; 362/85; 362/29; 362/295; 362/276; 362/240

[58] Field of Search ..... 362/85, 251, 86, 362/29, 30, 295, 276, 802, 240

[56] References Cited

U.S. PATENT DOCUMENTS

| | | | |
|---|---|---|---|
| 2,824,954 | 2/1958 | Roper | 362/85 |
| 3,004,193 | 10/1961 | Bentham et al. | 362/253 |
| 3,872,294 | 3/1975 | O'Toole | 362/85 |
| 5,174,643 | 12/1992 | Priesemuth | 362/276 |
| 5,905,442 | 5/1999 | Mosebrook et al. | 362/85 |

*Primary Examiner*—Alan Cariaso
*Assistant Examiner*—Ronald E. DelGizzi
*Attorney, Agent, or Firm*—Paul J. Sutton

[57] ABSTRACT

A demonstration display for light controls supports a number of lamps mounted behind translucent light transmitting panels each with a lighting control coupled thereto whereby the amount of light produced by the associated lamp is controlled by the setting of the controls. By operating the control, the user can vary the amount of light produced and appreciate the manner in which the control operates. The user can, by comparing various controls, select the one which meets his needs for installation.

24 Claims, 6 Drawing Sheets

DEMONSTRATION DISPLAY FOR LIGHTING CONTROLS

BACKGROUND OF THE INVENTION

1. Field of the Invention

The invention pertains to a device for displaying the range of control over various devices which can be achieved with certain control devices and more particularly to a demonstration display which provides a number of lamps and an equal number of controls so that a user can manipulate the controls and compare the resulting light output.

2. Description of the Prior Art

Presently there is no equivalent to the instant invention in use today. Individual controls can be wired to fans or motors or lights and the user can operate them to see the range of speed or light output that can be achieved with a particular control. There is little ability to compare controls with the same lamp. Further, the display may be remote from the place where the stock of these controls is located which does not assist in locating the desired controls.

SUMMARY OF THE INVENTION

The present invention is a demonstration display device which can be attached to the edge of a shelf or placed upon the shelf. The display includes alternating control supporting panels and light transmitting panels. Behind the light transmitting panels is a lamp which can be controlled by, for example, a slide dimmer mounted on the adjacent control supporting panel and operated by a user. The user can see the range of lighting intensity available by using the control. He can compare that control with others each of which has its own control. Data about the dimmer can be placed on the light transmitting panels which are translucent. The device can be mounted on the end of a shelf or placed upon a shelf with a stock of demonstrated controls behind the device.

The device is made up of a base member with a top, bottom and back having an open front face. Mounting lips project from the top and bottom and extend partially into the open front face. Alternating control supporting panels and light transmitting panels are placed along the base member using the mounting lips to hold such panels to the base member. A lamp is placed on the base member at each light transmitting panel. Each lamp is wired to a separate control and a source of electronical power so that a user operating the control can see its effect on the associated lamp. By using multiple bulbs and multiple controls the user is able to compare the operation of one control with that of the others. The device can be mounted to or on a shelf, so that a supply of the controls is quickly available to the user to purchase. It is an object of the instant invention to provide a multiple lamp and control display.

It is an object of this invention to provide a display in which lamp controls can be operated to alter the light output of an associated lamp.

It is an object of the instant invention to provide a demonstration display device which can be attached to or mounted on a shelf.

Other objects and features of the invention will be pointed out in the following description and claims and illustrated in the accompanying drawings, which disclose, by way of example, the principles of the invention, and the best mode which is presently contemplated for carrying them out.

BRIEF DESCRIPTION OF THE DRAWINGS

In the drawings in which similar elements are given similar reference characters.

DESCRIPTION OF THE PREFERRED EMBODIMENT

Figure 1:
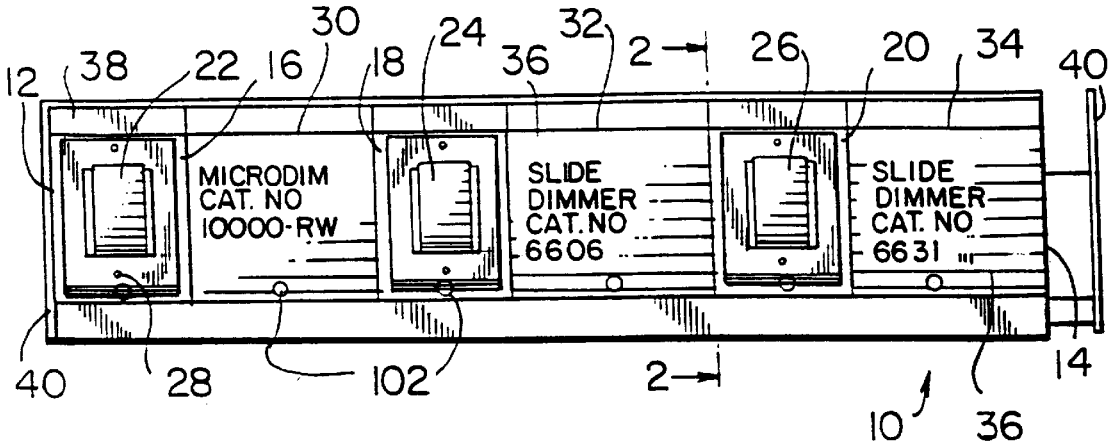
FIG. 1 front elevational view of a demonstration display for lighting controls constructed in accordance with the concepts of the invention.

Turning to FIG. 1 a demonstration display device 10 for lighting controls is shown. Between opposite ends 12, 14 are positioned a number of panels which are attached to a base member to be described below. Panels 16, 18 and 20 are control supporting panels made of an opaque material such as a black acrylic. To each of these controls support panels a lighting control device 22, 24, 26 are fastened as by screws 28. The control devices may be dimmers, such as box mounted dimmers (single-pole, 3-way, master and remote), cord dimmers, socket dimmers, tabletop dimmers, occupancy sensors or radio frequency devices. The three controls 22, 24 and 26 in use at any time are usually different but do not have to be. Any arrangement or combination of controls can be employed. Placed adjacent to each of the control supporting panels 16, 18 and 20 are light transmitting panels 30, 32, 34 which are formed of a translucent material such as white acrylic. As will be described below, a lamp is located behind each of the light transmitting panels and is wired to the particular control to be demonstrated by that lamp and to a source of AC electrical power. Thus control 22 is demonstrated by the lamp behind light transmitting panel 30 control 24 is demonstrated by the lamp behind light transmitting panel 32 and control 26 is demonstrated behind light transmitting panel 34. The demonstration of the functioning of these controls 22, 24 and 26 permits the dimming properties of each control to be appreciated and compared. Information regarding the adjacent control, such as its catalog number, voltage and wattage rating can be placed upon the panels 30, 32 and 34 as at 36. The control supporting panels also have a built-up area 38 where the manufacturer's name or trademark can be placed. The ends 12, 14 of the display device 10 are closed by end plates 40 of an opaque material, such as black styrene.

The device 10 as shown in FIG. 1 is 60.96 cms long, 17.78 cms high and 12.7 cms deep. The control support panels 16, 18 and 20 are 12.98 cms high and 8.16 cms wide and the light transmitting panels 30, 32 and 34 are 12.98 cms high and 12.07 cms wide. Device 10 permits the demonstration display of three control devices, however it can be lengthened or shortened to fit available space and to display the required number of controls. Also, the control supporting panels and light transmitting panels can be enlarged or reduced as needed.

Figure 6:
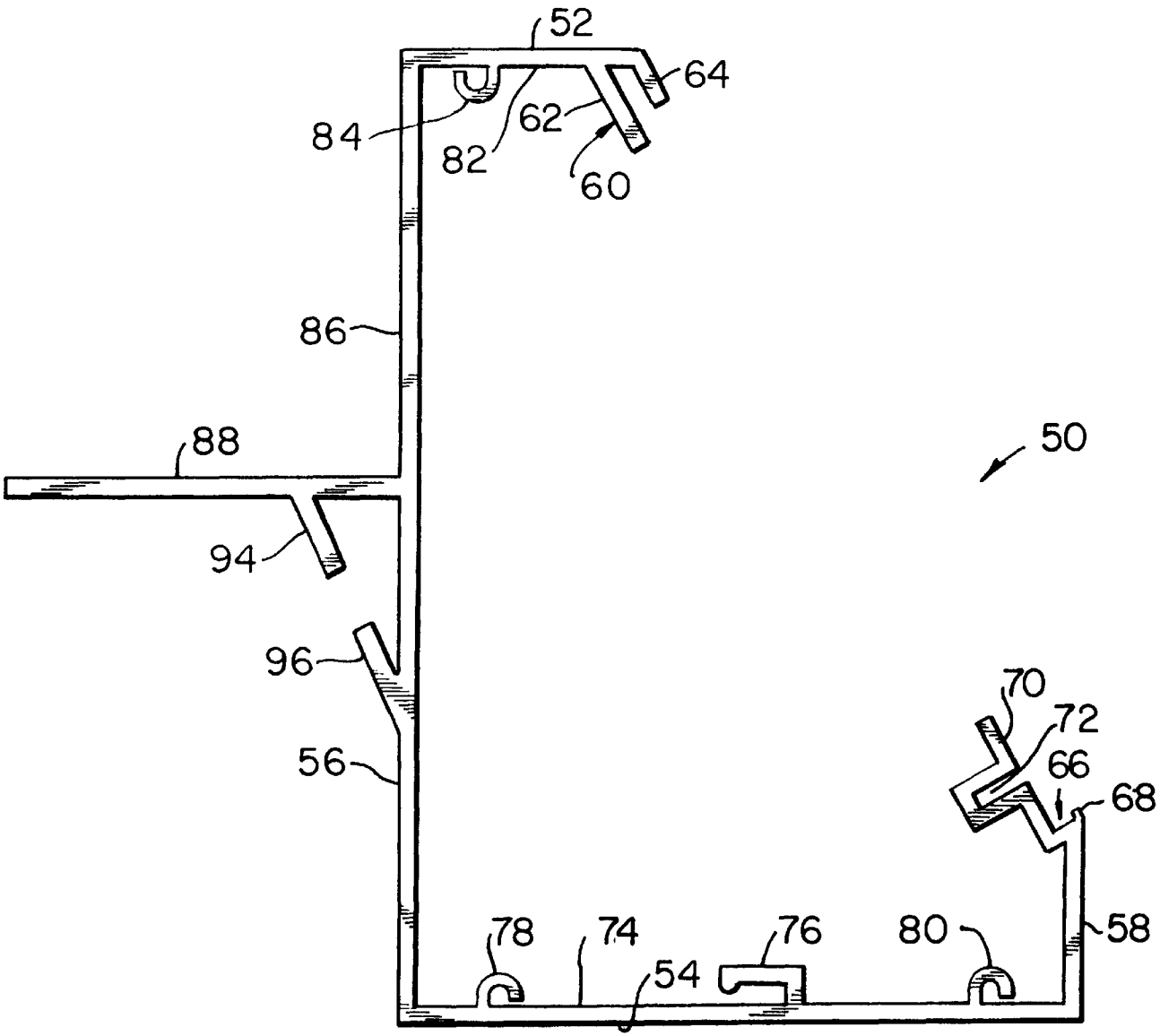
FIG. 6 is a side elevational view of the base member of the device of FIG. 1.

Referring now to FIG. 6, the construction of the base member 50 is described. Base member 50 is an extrusion of a suitable material such as polyvinyl chloride or the like and is as long as the overall device 10, that is a single extended base member 50 is used for each device 10. Base member 50 has a top portion 52, a bottom portion 54 both connected to a rear portion 56 along a first free edge in such a manner as to leave a substantially open front portion 58. A first track 60 extends from the free end of top portion 52 and is formed of two finger 62, 64 separated by approximately the thickness of the control supporting panels 16, 18 and 20 and light transmitting panels 30, 32 and 34. First track 60 projects into the open front portion 58. A second track 66 extends from the free end of front portion 58 and extends into such front portion 58. Second track 66 is made up of a rib 68 and a member 70 spaced from one another by approximately the thickness of the control supporting panels 16, 18 and 20 and light transmitting panels 30, 32 and 34. A recess 72 is placed in member 70.

On the inner surface 74 of bottom portion 54 is placed rib 76 to engage lamp sockets as will be described below. Hook-like structures 78 and 80 are also placed on inner surface 74 to receive fastening screws to hold the end plates 40 adjacent ends 12, 14 of device 10. The inner surface 82 of top portion 52 also contains a hook-like structure 84 thereon. The outer surface 86 of rear portion 56 includes an extending lipmount 88 which can be fastened to a shelf, a rack cross beam or any other support surface using fasteners passed through suitable apertures 90 (see FIGS. 7 and 8). Two support arms 94, 96 engage the shelf and help support and position the device 10.

Figure 2:
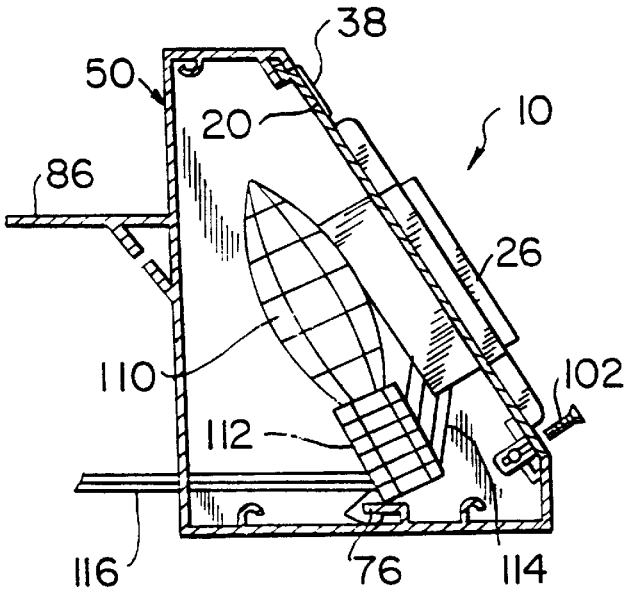
FIG. 2 is a side elevational view of the display of FIG. 1 with an end plate removed to display the inside of the device of FIG. 1.
Figure 5:
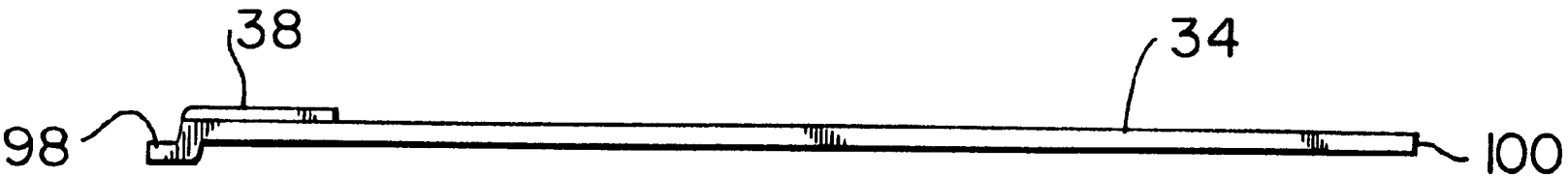
FIG. 5 is a side elevational view of a light transmitting panel.

Turning now to FIGS. 2 and 5 the assembly of display device 10 is shown. Control supporting panel 20 has an offset end portion 98 to fit within the first track 60 of the base member 50. The offset is sufficient to permit the main body of panel 20 to lie flat. The opposite end 100 fits into the second track 66 and engages rib 68 and lies along the surface of member 70. A fastener such as a rivet 102 is inserted through an aperture in panel 20 into recess 72 in member 70 to fasten the panel 20 to base member 50. Assembly of panel 20 is carried out by inserting the offset end portion 98 in track 60 and moving the end 100 into contact with rib 68 and member 70. The fastener can also be a removable type such as a self threading sheet metal screw so that the control on panel 20 can be changed or the whole panel replaced. The light transmitting panels 30, 32 and 34 are similar to the control supporting panels 16, 18 and 20 in that they include an offset portion 98 and an end 100 to engage the second track 66. These panels 30, 32 and 34 also receive a fastener such as a rivet or threaded fastener to hold panels 30, 32 and 34 in assembly with base member 50.

A lamp 110 is positioned behind light transmitting panel 34 (not shown). The lamp 110 is a standard 3" candelabra based lamp mounted in a socket 112 fixed under rib 76. The socket 112 is connected by wires 114 to the control 26 and to a source of AC electrical power by wires 116. Each of the three lamps is coupled in parallel across the power lines 116 so that the three controls 22, 24 and 26 operate independently and without affecting the other controls. Each of the controls 22, 24 and 26 is wired in series with its associated lamp 110 to control the light output of such lamp.

Figure 3:
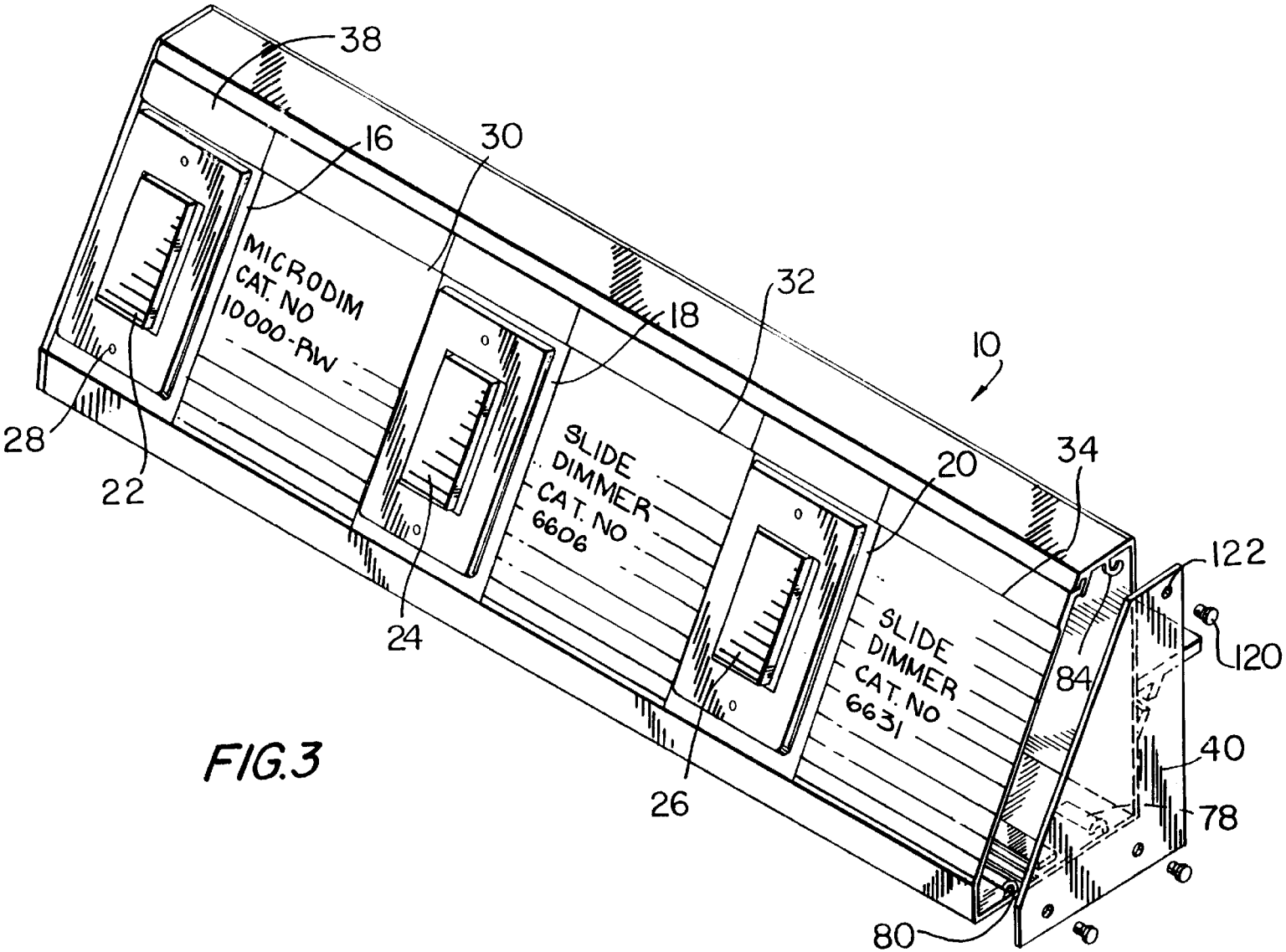
FIG. 3 is a front perspective view of the exterior of the display of FIG. 1 with one end plate removed.
Figure 4:
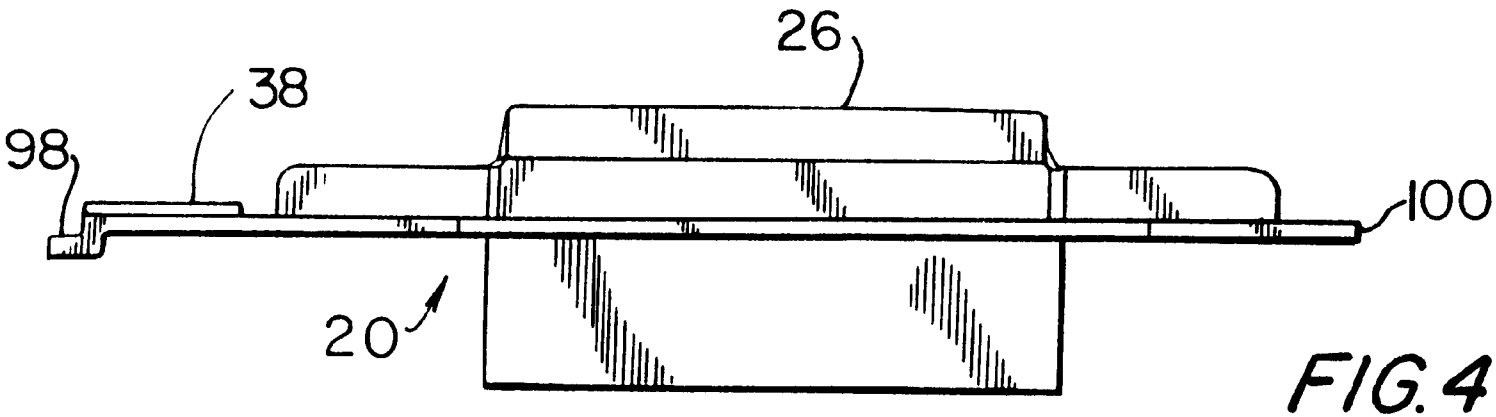
FIG. 4 is a side elevational view of a control supporting panel.

Once the lamps 110, the control supporting panels 16, 18 and 20 and the light transmitting panels 30, 32 and 34 are fixed in place the display device can be fully enclosed by adding end plates 40 to ends 12 and 14 of display device 10. As shown in FIG. 3, the end plates 40 each receive three screws 120 which extend through apertures 122 and engage respectively with hook-like structures 78, 80 and 84. Note that end plates 40 in FIG. 3 is shown as transparent to better appreciate the interior of base member 50 but are, as stated above, actually fabricated of an opaque material.

Figure 7:
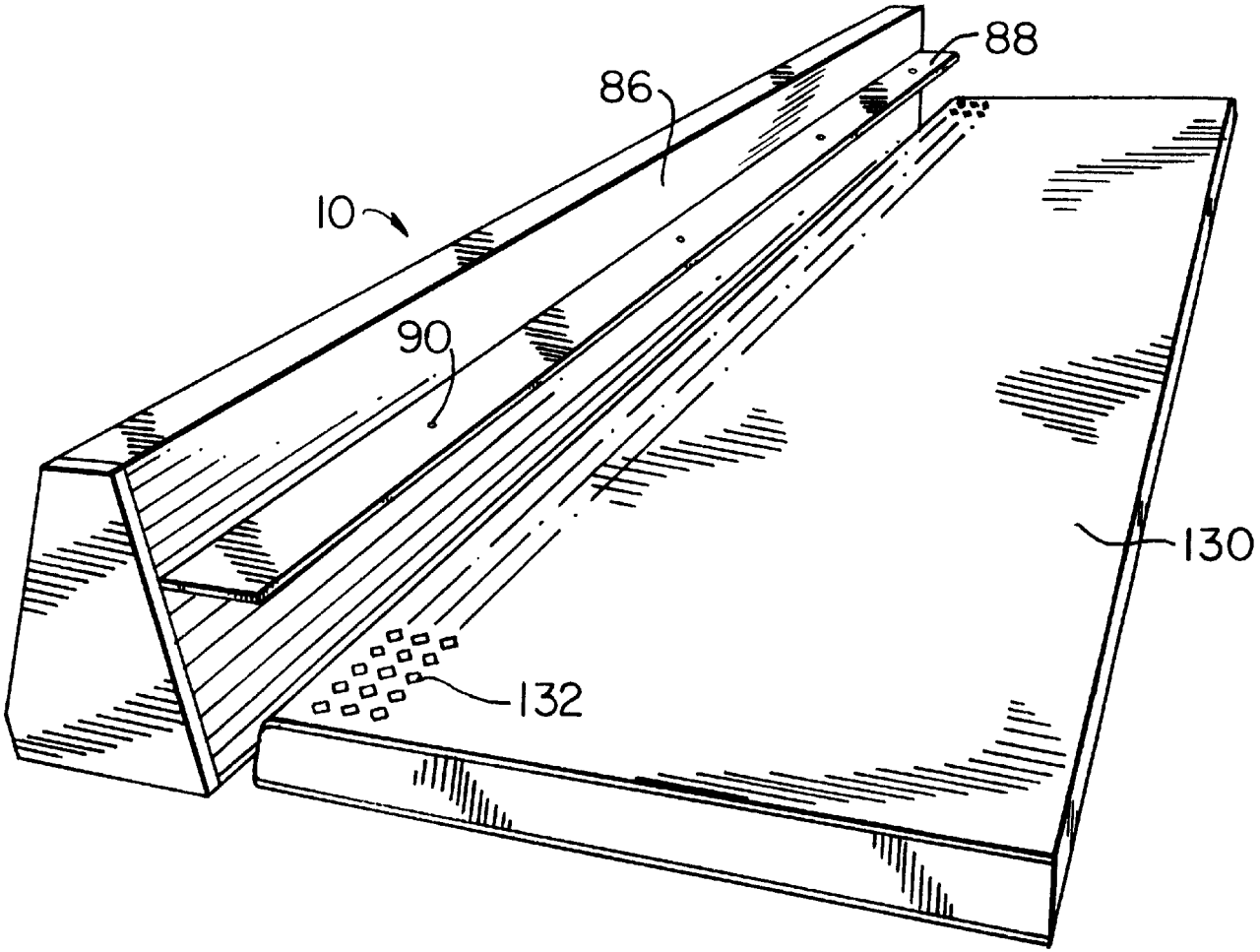
FIG. 7 is a perspective view of the rear portion of the device of FIG. 1 adjacent to a gondola-type shelf to which such device is mounted.
Figure 8:
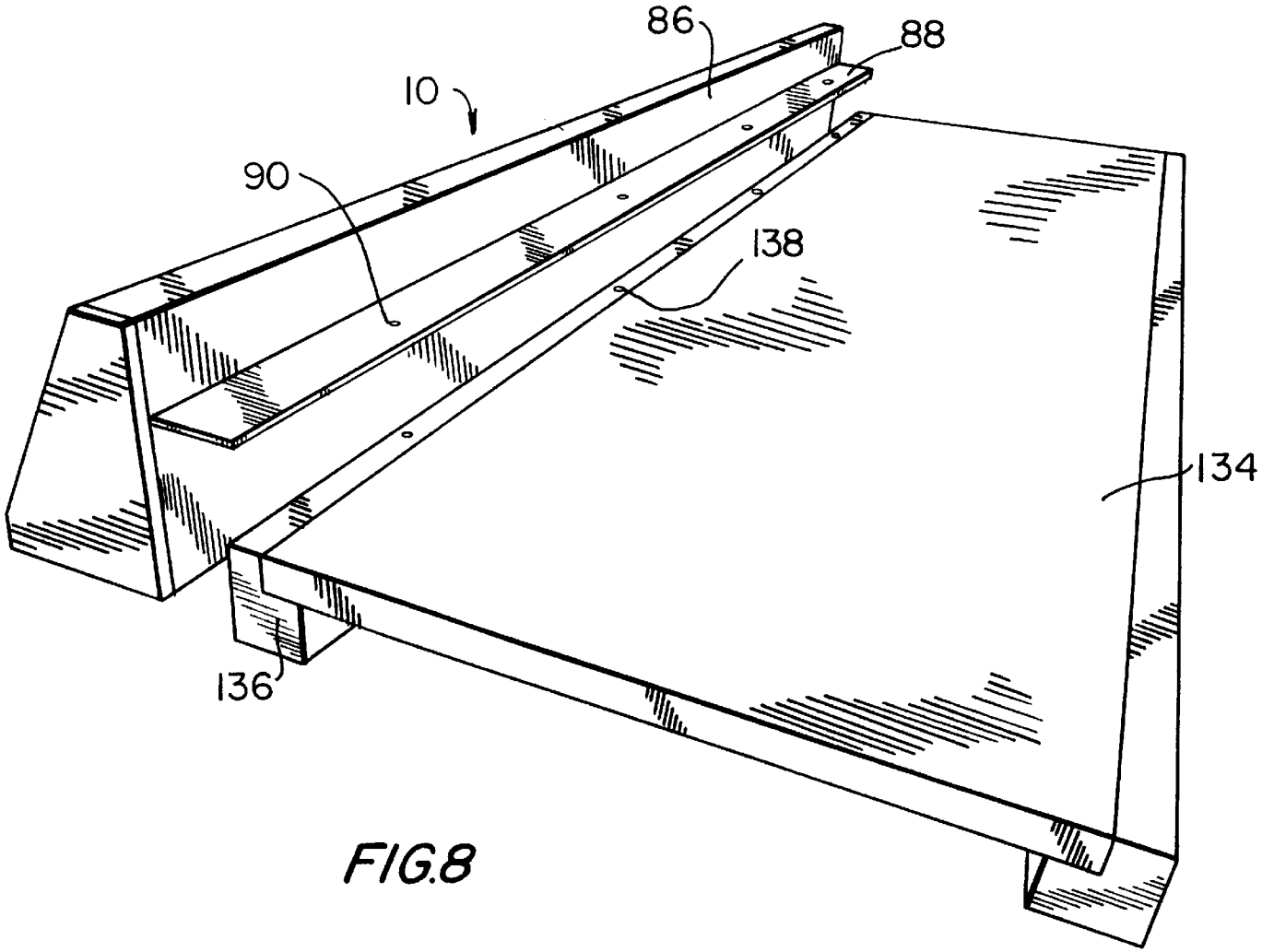
FIG. 8 is a perspective view of the rear portion of the device of FIG. 1 adjacent to a racking cross beam shelf upon which such device is mounted.

The completed display device can now be mounted to a gondola shelf 130 as shown in FIG. 7. A number of apertures 90 are placed in lipmount 88 and fasteners (not shown) are passed through the apertures 132 and fastened with a nut on the underside of shelf 130 (not shown). The display device 10 can also be fastened to a racking cross beam shelf (see FIG. 8) using self taping sheet metal screws (not shown) extending through apertures 90 into the cross beam 136 as at 138.

While there have been shown and described and pointed out the fundamental novel features of the invention as applied to the preferred embodiment, as is presently contemplated for carrying them out, it will be understood that various omissions and substitutions and changes of the form and details of the device illustrated and in its operation may be made by those skilled in the art, without departing from the spirit of the invention.

We claim:

1. A demonstration display for lighting controls comprising:

(a) a base member having a top portion, a bottom portion and a rear portion joined to leave a substantially open front panel;

(b) at least one light transmitting panel, each having a first edge and a second edge;

(c) at least one lamp, one for each of said at least one light transmitting panels, each of said at least one lamp being mounted behind an associated light transmitting panel and the light of said at least one of said lamp visible there through;

(d) at least one control supporting panel, one for each of said at least one light transmitting panel, each of said at least one control supporting panel positioned adjacent said at least one light transmitting panels;

(e) at least one control, one for each of said at least one lamp, each positioned on one of said at least one control supporting panel and operable by a user;

(f) wiring coupling said at least one control to an associated one of said at least one lamp and a source of electrical power whereby a light output from one of said at least one lamp can be manipulated and the light output of said associated one of said at least one lamp is viewed through an associated one of said at least one light transmitting panel; and (g) means to fasten each of said at least one light transmitting panel and each of said at least one control supporting panel to said base member.

2. A demonstration display, as defined in claim 1, wherein said at least one light transmitting panel is fabricated from a translucent material.

3. A demonstration display, as defined in claim 2, wherein said translucent material is white acrylic.

4. A demonstration display, as defined in claim 1, wherein said at least one control supporting panel is fabricated from an opaque material.

5. A demonstration display, as defined in claim 2, wherein said at least one control supporting panel is fabricated from an opaque material.

6. A demonstration display, as defined in claim 4, wherein said opaque material is opaque acrylic.

7. A demonstration display, as defined in claim 1, further comprising:

(a) said base member having a first end and a second end; and (b) end plates, one for each of said first and second ends of said base member to close the respective first and second ends.

8. A demonstration display, as defined in claim 7, wherein said end plates are fabricated from an opaque material.

9. A demonstration display, as defined in claim 8, wherein said opaque material is black styrene.

10. A demonstration display for lighting controls comprising:

(a) a base member having a top portion, a bottom portion and a rear portion joined to leave a substantially open front portion, a first track at a free end of said top portion and partially projecting into said open front portion and a second track at a free end of said bottom portion and partially projecting into said open front portion;

(b) at least one light transmitting panel, each one of said at least one light transmitting panel having a first edge for receipt in said first track and a second edge for receipt in said second track;

(c) at least one lamp, one for each of said at least one light transmitting panel, each of said at least one lamp being mounted on said bottom portion of said base member and behind an associated one of said at least one light transmitting panel;

(d) at least one control supporting panel, one for each of said at least one light transmitting panels, each of said at least one control supporting panel having a third edge for receipt in said first track and a fourth edge for receipt in said second track, each of said at least one control supporting panel is positioned adjacent at least one of said at least one light transmitting panel;

(e) at least one control, one for each of said at least one lamp, each positioned on one of said at least one control supporting panel and operable by a user; and (f) wiring coupling said at least one control to an associated one of said at least one lamp and a source of electrical power whereby a light output from one of said at least one lamp can be manipulated and the light output of said associated one of said at least one lamp is viewed through an associated one of said at least one light transmitting panel.

11. A demonstration display, as defined in claim 10, wherein said back portion has a lipmount thereon extending outwardly from said back portion to permit said display to be mounted to a shelf.

12. A demonstration display, as defined in claim 10, wherein said at least one light transmitting panel is fabricated from a translucent material.

13. A demonstration display, as defined in claim 12, wherein said translucent material is white acrylic.

14. A demonstration display, as defined in claim 10, wherein said at least one control supporting panel is fabricated from an opaque material.

15. A demonstration display, as defined in claim 12, wherein said at least one control supporting panel is fabricated from an opaque material.

16. A demonstration display, as defined in claim 14, wherein said opaque material is opaque acrylic.

17. A demonstration display, as defined in claim 10, further comprising:

(a) said base member having a first end and a second end; and (b) end plates, one for each of said first and second ends of said base member to close the respective first and second ends.

18. A demonstration display, as defined in claim 17, wherein said end plates are fabricated from an opaque material.

19. A demonstration display, as defined in claim 18, wherein said opaque material is black styrene.

20. A demonstration display, as defined in claim 10, wherein said at least one control is a dimmer.

21. A demonstration display, as defined in claim 10, wherein said at least one control is a dimmer with on/off switch.

22. A demonstration display, as defined in claim 10, wherein said at least one control is an occupancy sensor.

23. A demonstration display, as defined in claim 10, wherein said at least one control is a radio frequency device.

24. A demonstration display, as defined in claim 10, wherein information pertaining to said at least one control is displayed on an adjacent one of said at least one light transmitting panels.

* * * * *